US006323773B1

(12) United States Patent
Runyon et al.

(10) Patent No.: US 6,323,773 B1
(45) Date of Patent: Nov. 27, 2001

(54) ALERTING DEVICE AND METHOD FOR REMINDING A PERSON OF A RISK

(75) Inventors: Larry Runyon, Richland; Wayne M. Gunter, West Richland; Richard M. Pratt, Richland, all of WA (US)

(73) Assignee: Battelle Memorial Institute, Richland, WA (US)

( * ) Notice: Subject to any disclaimer, the term of this patent is extended or adjusted under 35 U.S.C. 154(b) by 0 days.

(21) Appl. No.: 09/596,176

(22) Filed: Jun. 16, 2000

(51) Int. Cl.[7] ..... G08B 23/00

(52) U.S. Cl. ..... 340/573.1; 340/573.4; 340/565; 340/567; 340/541; 340/522

(58) Field of Search ..... 340/573.1, 573.4, 340/573.7, 565, 567, 541, 517, 522, 524

(56) References Cited

U.S. PATENT DOCUMENTS 4,912,457 3/1990 Ladd ..... 340/573
5,726,629 3/1998 Yu ..... 340/565
5,760,686 6/1998 Toman ..... 340/540
6,157,299 * 12/2000 Wang ..... 340/506

* cited by examiner

*Primary Examiner*—Daryl Pope
(74) *Attorney, Agent, or Firm*—Stephen R. May

(57) ABSTRACT

An alerting device and method to remind personnel of a risk is disclosed. The device has at least two sensors, a logic controller, a power source, and an annunciator that delivers a visual message, with or without an audible alarm, about a risk to a person when the sensors detect the person exiting a predetermined space. In particular, the present invention reminds a person of a security, safety, or health risk upon exiting a predetermined space. More particularly, the present invention reminds a person of an information security risk relating to sensitive, proprietary, confidential, trade secret, classified, or intellectual property information.

22 Claims, 6 Drawing Sheets

ALERTING DEVICE AND METHOD FOR REMINDING A PERSON OF A RISK

This invention was made with Government support under Contract DE-AC0676RLO1830 awarded by the U.S. Department of Energy. The Government has certain rights in the invention.

FIELD OF THE INVENTION

The present invention is an alerting device and method to detect a person exiting a predetermined space proximate to a risk and to remind the person of the risk. The term "risk," used hereinafter, is defined as a possibility of loss, illness, or injury.

BACKGROUND OF THE INVENTION

Information is the lifeblood of any organization, especially its sensitive, proprietary, confidential, trade secret, or classified information. When it is lost or compromised to an adversary, or competitor, the organization's reputation and ability to compete could be severely damaged or ruined. More importantly, national security interests could be jeopardized.

Protecting an organization's business information, and business property in general, from loss demands that there be an active and meaningful security awareness program in place. Security professionals have traditionally relied on security training, briefings, videos, security posters, warning signs, etc., to help remind personnel of their day-to-day responsibilities in protecting information and physical property. These methods alone, however, have proven to be unsatisfactory based on the continuing problems of information security infractions and loss of property.

This problem can be explained, in part, through various scientific studies that have shown that the typical work environment has been overcome by visual pollution. That is, there is too much visual information being pushed at personnel, such information becoming "part of the woodwork." For example, within a short period of time a security poster at an office exit fails to capture the attention of personnel and they become oblivious to the poster and its message. Security briefings and videos also receive low marks for helping to sustain employee security awareness and minimizing complacency, mental lapses, forgetfulness, and inattention to detail.

Such inadequacies are also important contributing factors in many occupational accidents and illnesses. Similar to security personnel, occupational or industrial safety/health professionals rely on personnel being well trained and knowledgeable of procedures to protect themselves and coworkers. Depending on the specific job hazards, additional lines of defense may be established that include passive warning signs and physical barriers. Like security defenses, however, personnel may become accustomed, and oblivious, to these safety defenses over time.

A variety of indoor and outdoor devices exist that warn a person, through audible and/or visual means, upon detection of a person's or object's presence in a monitored area. For example, the devices of U.S. Pat. Nos. 4,912,457, and 5,726,629 warn or greet a person audibly and visually upon detection of the person: the '457 device can remind a machine tool operator to use safety guards on machinery when the operator is close to the machine tool and the '629 patent discloses a home security application whereby the sound of a dog barking can be delivered to the intruder whose presence is detected. U.S. Pat. No. 5,760,686 discloses a device that warns workers in a roadway work zone of an errant vehicle by the use of motion detectors targeting the perimeter of the zone and a high intensity strobe light array.

No devices exist, however, that meet the needs of security and occupational or industrial safety/health professionals. Simple, low-cost, and effective reminders for personnel are needed for those circumstances whereby the level of risk significantly increases as a person exits an area near the risk. For example, there are situations whereby personnel need to be reminded to:

- Secure sensitive or classified information in hardcopy or electronic form,
- Lock safes, files, the office door, or other security barriers,
- Secure or store valuable or hazardous materials and equipment after use,
- Return equipment or materials,
- Clean the work area,
- Remove potentially-contaminated personal protection clothing, and
- Deenergize equipment or appliances.

Accordingly, there is a continuing need for a simple, low-cost, and effective alerting device that reminds a person of a risk upon sensing the person exiting an area near the risk.

BRIEF SUMMARY OF THE INVENTION

The present invention provides an alerting device and method to remind personnel of a risk. The device has at least two sensors, a logic controller, a power source, and an annunciator that delivers a visual message, with or without an audible alarm, about a risk to a person when the sensors detect the person exiting a predetermined space. In particular, the present invention reminds a person of a security, safety, or health risk upon exiting a predetermined space. More particularly, the present invention reminds a person of an information security risk relating to sensitive, proprietary, confidential, trade secret, classified, or intellectual property information. Details of the device are set forth below only as may be necessary for a proper understanding of the invention since specific details will be apparent to persons skilled in the art, including those skilled in sensor technology, control logic, and electronic circuit design.

An object of the present invention is to remind a person of a risk upon detection of the person exiting a predetermined space proximate to the risk.

A further object of the present invention is to alert personnel in a manner such that the invention does not become a nuisance and does not negatively impact personnel productivity.

A further object of the present invention is to reduce the number of information security infractions.

A further object of the present invention is to reduce property losses.

A further object of the present invention is to improve the safety of personnel and reduce the number workplace-related illnesses, injuries, and deaths.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DETAILED DESCRIPTION OF THE INVENTION

Figure 1A:
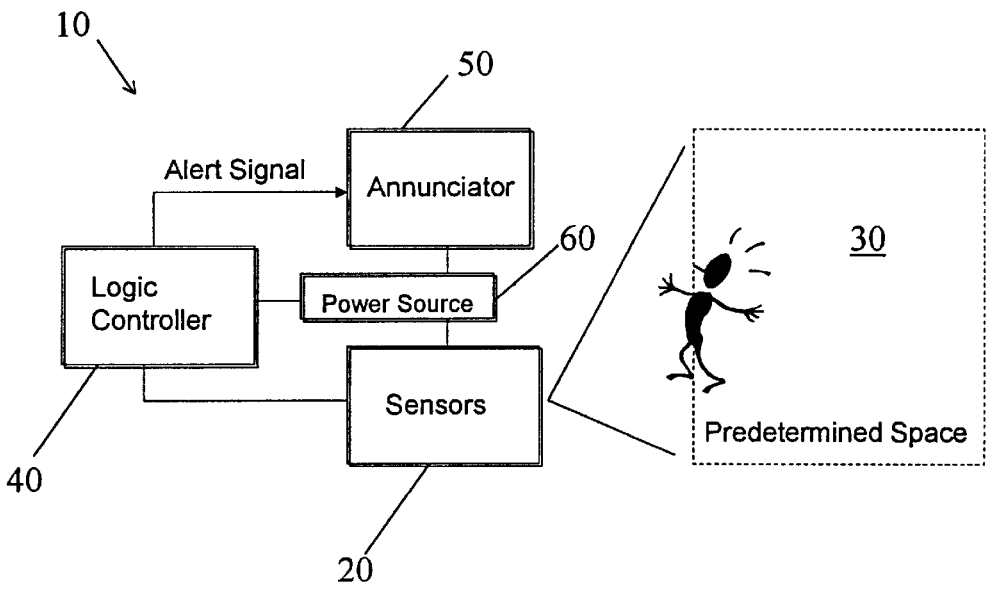
FIG. 1*a* is a simplified schematic of the present invention.
Figure 1B:
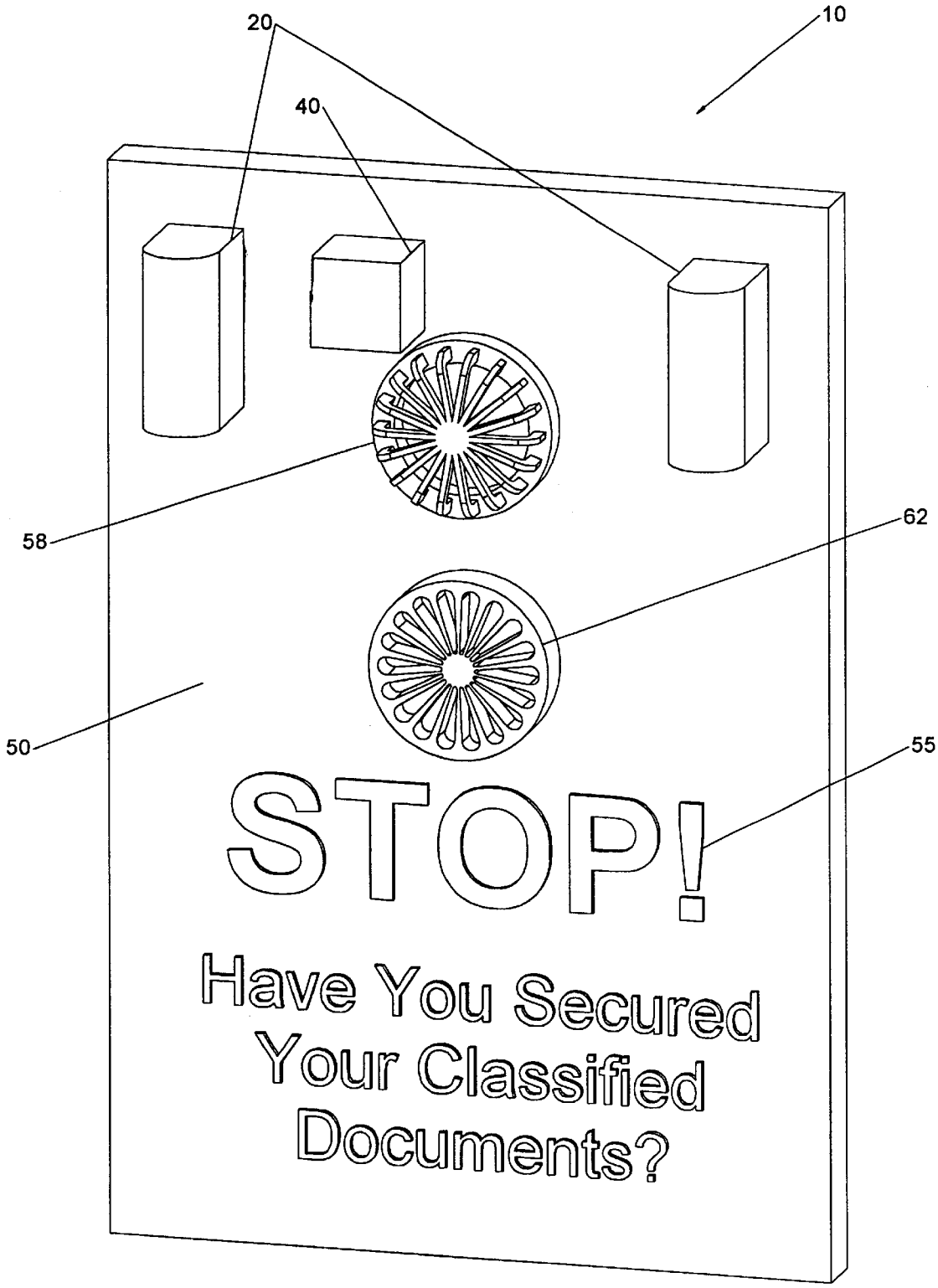
FIG. 1*b* illustrates an example of an embodiment of the present invention.

FIG. 1*a* is a simplified schematic of the present invention and FIG. 1*b* illustrates one of many possible embodiments of the alerting device 10. At least two sensors 20 monitor a predetermined space 30 wherein each sensor 20 transmits a signal, dependent upon the location of a person in the predetermined space 30, to a logic controller 40. If the combination of signals represent a person exiting the predetermined space 30 (as shown in FIG. 1*a*), the logic controller 40 transmits an alert signal to an annunciator 50. The annunciator 50 includes a sign 55 and a light means 58 for illuminating the sign 65 upon receipt of the alert signal from the logic controller 40. The sign 55 displays an alert message for the person to acknowledge and upon which to act. Energy for each sensor 20, the logic controller 40, and the annunciator 50 is provided by the power source 60 (electronic/electrical wiring and power source not shown in FIG. 1*b*).

Figure 2:
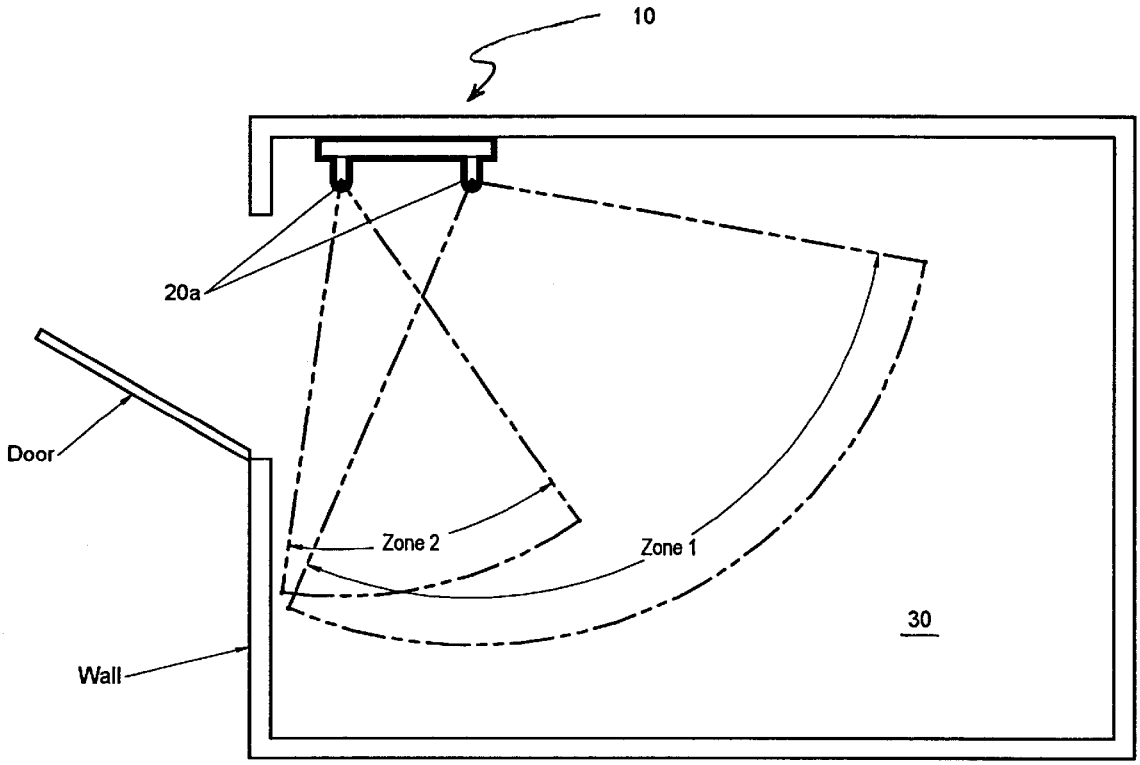
FIG. 2 illustrates an embodiment of the present invention with two IR motion detectors.
Figure 3:
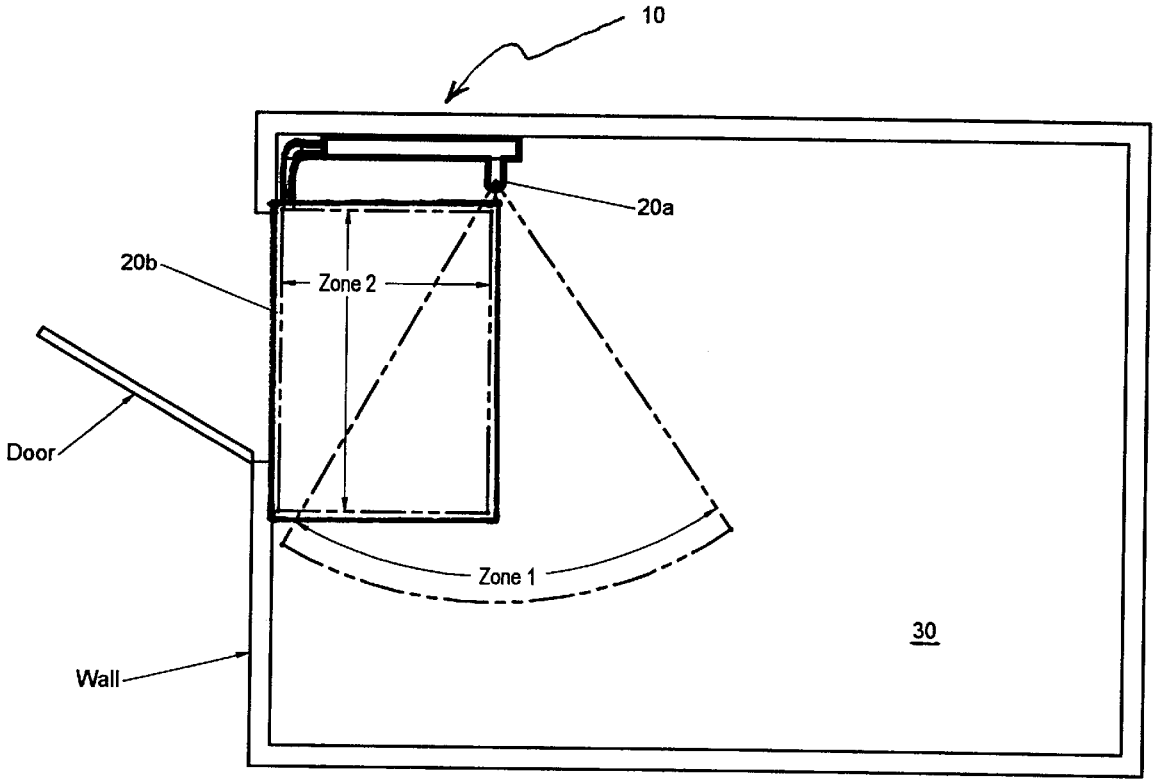
FIG. 3 illustrates an embodiment of the present invention with an IR motion detector and a pressure switch sensor.
Figure 4:
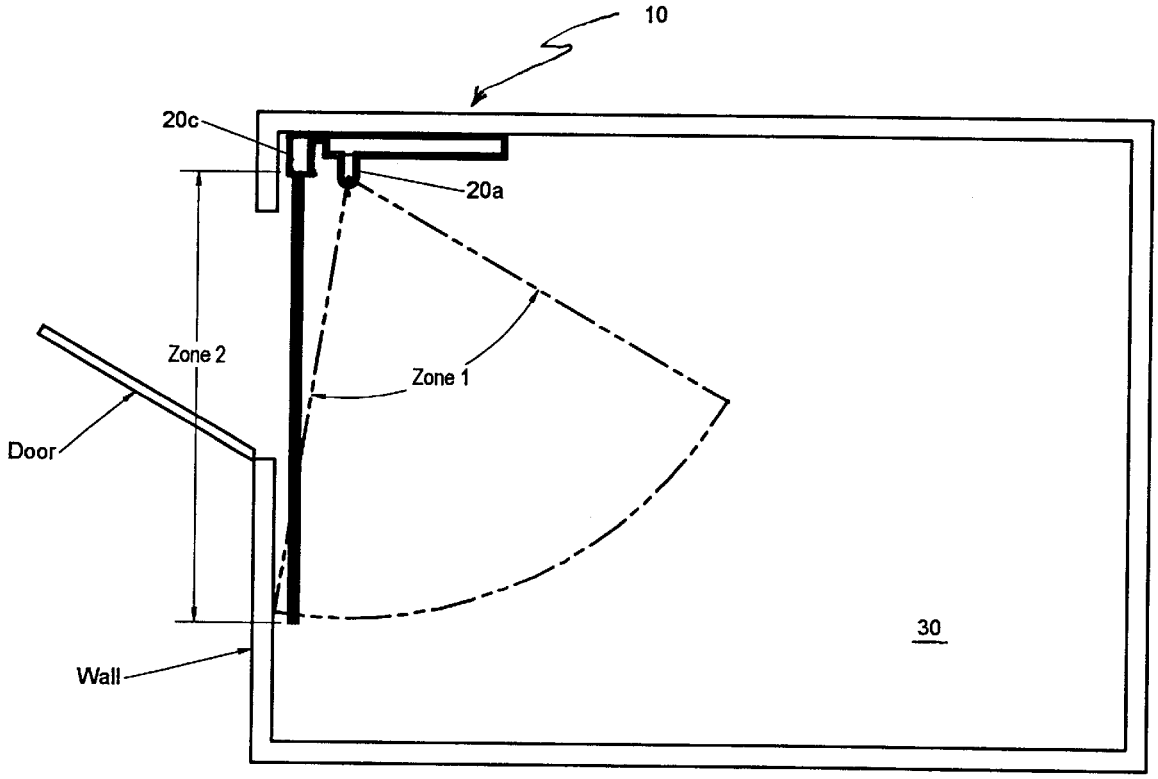
FIG. 4 illustrates an embodiment of the present invention with an IR motion detector and an optical motion detector.
Figure 5:
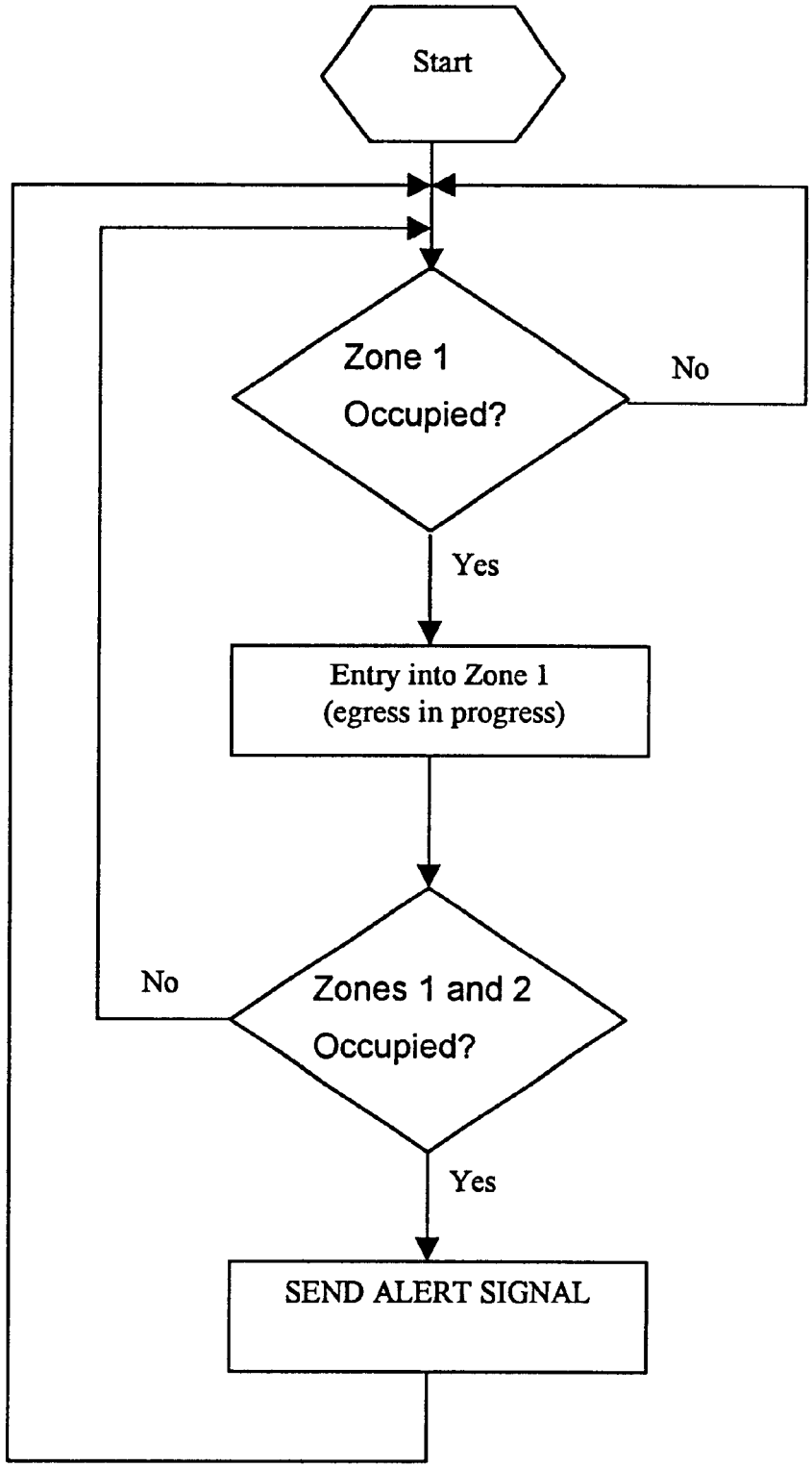
FIG. 5 is a logic flowchart for the embodiments shown in FIGS. 2–4.

The sensors 20 may be any combination of sensing devices capable of detecting a person and the direction the person is moving in the predetermined space 30. For example, FIGS. 2–4 illustrate three embodiments of the present invention using a different combination of sensors 20 and a predetermined space 30 exemplified by a room with four walls and a door. Each sensor 20 is effective in detecting a person within a volume in the predetermined space 30, hereinafter referred to as its "detection zone." FIG. 2 illustrates the alerting device 10 mounted on a wall and having two infrared (IR) motion detectors 20*a* as the sensors 20. In this embodiment, one of the IR motion detectors 20*a* has a detection zone identified as "Zone 1" and the other IR motion detector 20*a* has a detection zone identified as "Zone 2". FIG. 3 illustrates the alerting device 10 having a wall-mounted IR motion detector 20*a* and a floor-mounted pressure switch 20*b*, activated by the weight of a person stepping on the pressure switch 20*b*, as the sensors 20. In this embodiment, the IR motion detector 20*a* has a detection zone identified as "Zone 1" and the pressure switch 20*b* has a detection zone identified as "Zone 2" on the floor. FIG. 4 illustrates the alerting device 10 having a wall-mounted IR motion detector 20*a* and a light-beam motion detector 20*c*, as the sensors 20. In this embodiment, the IR motion detector 20*a* has a detection zone identified as "Zone 1" and the light-beam motion detector 20*c* has a detection zone identified as "Zone 2". In all these embodiments, the detection zones 1 and 2 overlap, or nearly overlap, such that detection of a person in zone 1 only and then detection of a person in both zones 1 and 2 represents a person exiting the predetermined space 30 and results in an alert signal from the logic controller 40. It is evident that other detection logic combinations could be utilized to optimize performance. For example, referring to FIG. 3, a person exiting the predetermined space 30 could also be represented by detection of a person in both zones 1 and 2 and then detection of a person in zone 2 only. An example of a flowchart for the logic circuit in the logic controller 40 is shown schematically in FIG. 5. As known to those skilled in the art, such a logic circuit may comprise logic chips or a simple microprocessor.

Also known to those skilled in the art, other combinations of sensors 20 may be similarly used including, but not limited to, a floor-mounted pressure switch with a light-beam motion detector, multiple floor-mounted pressure switches, and multiple light-beam motion detectors. Furthermore, the sensors 20 may be in the form of a photo detector array such as that found in a digital camera. In this embodiment, the sensors 20 would transmit signals, representing the pixel characteristics in the picture frame of the camera, to the logic controller 40. Detected changes in these pixel characteristics that represent a person exiting the predetermined space 30 would result in the logic controller 40 transmitting an alert signal to the annunciator 50.

The predetermined space 30 is a space capable of being monitored by the sensors 20. For IR motion detectors 20*a*, the detection zones typically are spherical or conical in shape with a typical range of between about 0.5 and 3 m. The predetermined space 30 and location of the sensors 20 are typically identified by security, safety, or other personnel familiar with the monitoring sensors 20 to ensure objectives are met. Typically, a predetermined space 30 is a space near an exit of a specific work area. Anticipated work areas are those that are near a real or potential security or safety risk such as administrative, laboratory, industrial, construction, medical, and storage work areas. The work areas may be inside a building or out in the field such as a construction site.

As previously disclosed herein, the annunciator 50 includes an illuminable sign 55 that displays an alert message for the person to acknowledge and upon which to act. The alert message may be in the form of text (e.g., "Have you secured your classified material?", "Have you safely stored your chemicals?"), a well-recognized symbol or graphic (e.g., radiation symbol, stop sign), or combinations thereof. Illumination of such an alert message is by a light means 58 that may be separated from the sign 55 (as shown in FIG. 1*b*) or preferably, the sign 55 is made of illuminable elements such as light-emiffing diodes (not shown). It is further preferred that the illumination circuit (not shown) include a flasher such that a flashing light further draws attention to the alert message. Typically, the annunciator 50 is located proximate to the predetermined space 30 and placed on a wall, fence, ceiling, floor, or ground near an exit of a specific work area so that a person is capable of acknowledging the reminder upon exiting.

An alternative for the annunciator 50 is for the annunciator 50 to also include an audible alarm 62 (see FIG. 1*b*) that is activated when the annunciator 50 receives the alert signal to further draw attention to the illuminated alert message. The audible alarm 62 may be, but is not limited to, a bell, horn, electronic voice synthesizer, magnetic tape player, and combinations thereof. It is preferable that this alternative has a means to either manually or automatically deactivate the annunciator 50 and to reset the sensors 20 so as not to become a nuisance for personnel after activation. This may be accomplished manually by incorporating an acknowledgment switch (not shown) on the alerting device 10 that is activated by the person, or accomplished automatically through the use of an adjustable deactivation timer in the alarm circuit.

The power source 60 may be, but is not limited to, conventional building power, solar power, or battery power. It is preferable that the alerting device 10 comprises the sensors 20, the logic controller 40, the annunciator 50 and a power source 60 that is portable (e.g., battery, solar cell, and combinations thereof as an integral unit (e.g., as shown in FIG. 1*b*) to minimize installation cost as well as being easily portable from work area to work area, as required. For the alerting device 10 powered by a battery, it is preferred that there is a to convenient means for security and occupational or industrial safety/health professionals to routinely test the remaining life of the battery (e.g., a battery test port installed on the alerting device 10).

Anticipated security applications for the alerting device 10 include protecting physical property associated with valuable, difficult to replace, or hazardous equipment and materials, and protecting business information designated as sensitive, proprietary, confidential, trade secret, classified, and intellectual property. Anticipated safety applications include those associated with industrial safety and occupational health hazards. Industrial safety and occupational health hazards include toxic chemical and biological agents, blood-borne pathogens, and radioactive contamination.

CLOSURE

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. An alerting device for reminding a person of a risk, comprising:

a. at least two sensors, wherein each sensor monitors a predetermined space proximate to the risk and provides a signal dependent on the location of the person in said predetermined space;

b. a logic controller comprising a logic circuit that receives said signals and provides an alert signal only when said at least two sensors detects the person exiting said predetermined space;

c. an annunciator proximate to said predetermined space, wherein said annunciator comprises an illuminable sign displaying an alert message, said illuminable sign illuminated to remind the person of the risk when said annunciator receives said alert signal; and d. a power source for providing energy to said at least two sensors, said logic controller, and said annunciator.

2. The alerting device as recited in claim 1, wherein the risk is the possibility of loss of property.

3. The alerting device as recited in claim 2, wherein the property is business information selected from the group consisting of sensitive, proprietary, confidential, trade secret, and classified.

4. The alerting device as recited in claim 1, wherein the risk is the possibility of injury from an occupational hazard.

5. The alerting device as recited in claim 1, wherein at least one of said at least two sensors is an infrared motion detector.

6. The alerting device as recited in claim 1, wherein at least one of said at least two sensors is a light beam motion detector.

7. The alerting device as recited in claim 1, wherein at least one of said at least two sensors is a pressure switch.

8. The alerting device as recited in claim 1, wherein said at least two sensors is a photo detector array.

9. The alerting device as recited in claim 1, wherein said at least two sensors is two infrared motion detectors.

10. The alerting device as recited in claim 1, wherein said annunciator further comprises an audible alarm.

11. The alerting device as recited in claim 10, wherein said audible alarm is selected from the group consisting of a bell, horn, electronic voice synthesizer, magnetic tape player, and combinations thereof.

12. The alerting device as recited in claim 11, further comprising an acknowledgement switch.

13. The alerting device as recited in claim 11, further comprising an adjustable deactivation timer.

14. The alerting device as recited in claim 1, wherein said power source is selected from the group consisting of a battery, solar cell, and combinations thereof.

15. The alerting device as recited in claim 14, wherein said at least two sensors, said logic controller, said annunciator, and said power source are an integral unit.

16. The alerting device as recited in claim 15, further comprising a battery test port and wherein said power source is a battery.

17. A method for reminding a person of a risk, comprising the steps of:

a. Monitoring a predetermined space proximate to the risk with at least two sensors, wherein each sensor provides a signal dependent on the location of the person in said predetermined space;

b. Receiving said signals by a logic controller, said logic controller providing an alert signal only when said at least two sensors detects the person exiting said predetermined space; and c. Receiving said alert signal by an annunciator proximate to said predetermined space, said annunciator comprising an illuminable sign displaying an alert message, said illuminable sign illuminated when said annunciator receives said alert signal to remind the person of the risk.

18. The method as recited in claim 17, wherein the risk is the possibility of loss of property.

19. The method as recited in claim 18, wherein the property is business information selected from the group consisting of sensitive, proprietary, confidential, trade secret, and classified.

20. The method as recited in claim 17, wherein the risk is the possibility of injury from an occupational hazard.

21. The method as recited in claim 17, wherein at least one of said at least two sensors is an infrared motion detector.

22. The method as recited in claim 17, wherein said annunciator further comprises an audible alarm.

* * * * *